United States Patent [19]

Vogel

[11] Patent Number: 4,538,381

[45] Date of Patent: Sep. 3, 1985

[54] BENDABLE OVEN DOOR GASKET

[75] Inventor: K. Stuart Vogel, Weatherford, Tex.

[73] Assignee: Jamak, Inc., Weatherford, Tex.

[21] Appl. No.: 540,864

[22] Filed: Oct. 11, 1983

[51] Int. Cl.[3] ..... E06B 7/16

[52] U.S. Cl. ..... 49/479; 49/485; 49/493

[58] Field of Search ..... 49/479, 485, 494, 493, 49/492, 498

[56] References Cited

U.S. PATENT DOCUMENTS

| | | | |
|---|---|---|---|
| 2,139,239 | 12/1938 | Fessler | 296/44.5 |
| 2,263,806 | 11/1941 | Hammerl | 20/69 |
| 2,612,665 | 10/1952 | Scott | 20/69 |
| 2,938,249 | 5/1960 | Milne | 49/492 |
| 3,112,536 | 12/1963 | Gagnier | 20/69 |
| 3,167,824 | 2/1965 | Berwanger | 49/492 X |
| 3,167,826 | 2/1965 | Watzl et al. | 49/492 |
| 3,603,035 | 9/1971 | Kaldenberg | 49/485 |
| 4,248,017 | 2/1981 | Micallef | 49/493 |

FOREIGN PATENT DOCUMENTS

| | | | |
|---|---|---|---|
| 1040141 | 5/1953 | France | 49/479 |

*Primary Examiner*—Philip C. Kannan

*Attorney, Agent, or Firm*—James E. Bradley

[57] ABSTRACT

A gasket, particularly for use with an oven door, has features that allow it to be bent into a rectangular shape. The gasket has a base that is extruded with a tubular section that protrudes outwardly from it. A wire is simultaneously drawn through the base while the gasket is being extruded. The wire is sufficiently ductile to allow the gasket to be bent into a rectangular shape, and has sufficient strength to hold the gasket in that shape. Resilient metal clips are used to grip the base and extend into apertures provided in the oven for securing the gasket to the oven.

3 Claims, 4 Drawing Figures

FIG. 3
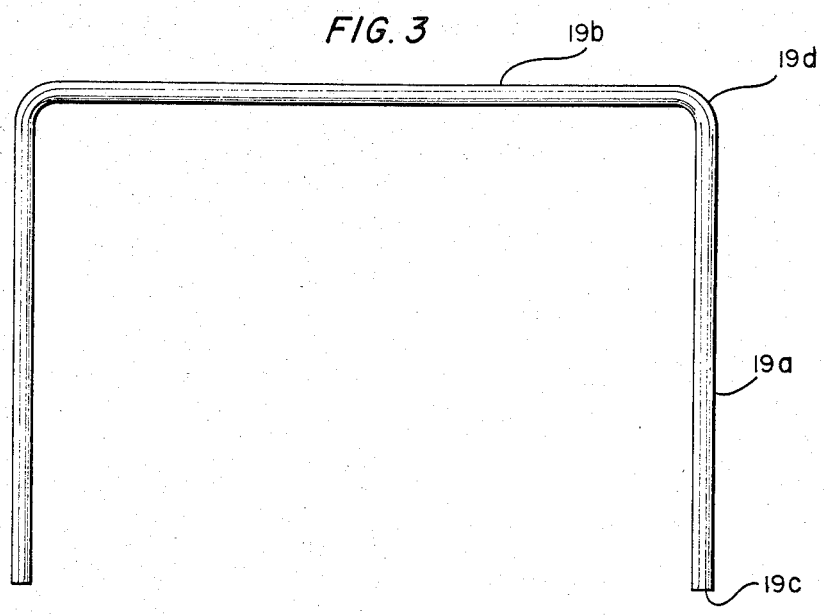
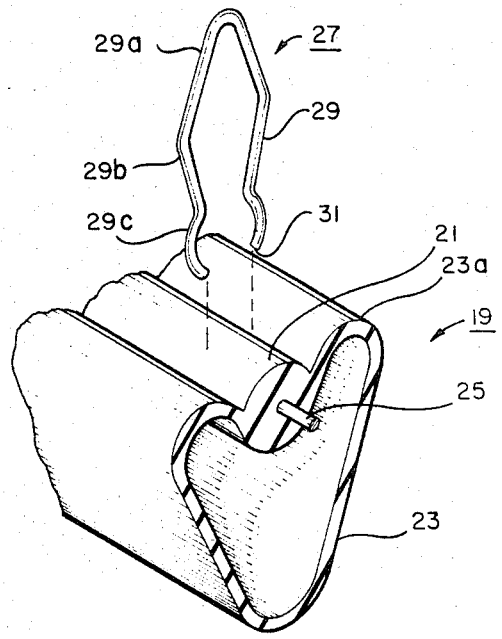
FIG. 4

BENDABLE OVEN DOOR GASKET

BACKGROUND OF THE INVENTION

1. Field of the Invention:

This invention relates in general to gaskets that seal between confronting surfaces, and in particular to a gasket for an oven door.

2. Description of the Prior Art:

Household ovens have gaskets located between the oven door and the frame of the oven for cushioning and for sealing the heat within. Many of these gaskets are formed of silicone rubber so as to resist temperature degradation and to have a long life. Normally, the oven door gasket of the prior art is made up of straight, elongated pieces, each for one side of the oven. Usually, there will be three pieces, one for the top, and one for each side, with the corners having small gaps between each straight piece. Normally, the pieces contain flat metal strips that extend all or part of the length of the gaskets for removably clipping the gaskets to apertures in the frame of the oven. This allows the gaskets to be removed for cleaning.

While these types are successful, a gasket manufacturer must cut the gaskets to various lengths depending upon the dimensions required by the oven manufacturer. The metal strips must be precisely positioned to locate within the holes. Considerable labor is involved in sizing and assembling these types of gaskets.

SUMMARY OF THE INVENTION

In this invention, a universal type gasket is provided for confronting surfaces, particularly for appliances such as an oven. The gasket is extruded with a configuration having a solid base and a tubular cushion portion. While being extruded, a wire is co-extruded through the solid base. The wire is sufficiently ductile to allow the gasket to be bent into 90 degree corners and sufficiently strong to retain the gasket in that shape.

Clips are installed with the gasket for clipping the gasket at any desired point. Each clip has two legs that are doubled back to form a loop for pressing through an aperture. The legs have ends that are adjacent to each other for gripping the base of the gasket. Preferably the ends of the clips pierce through the tubular portion to grip the base.

BRIEF DESCRIPTION OF THE DRAWINGS

FIG. 3 is a side view of the gasket of FIG. 1, shown apart from the oven.

FIG. 4 is a partial, enlarged perspective view of a portion of the gasket of FIG. 1.

DESCRIPTION OF THE PREFERRED EMBODIMENT

Figure 1:
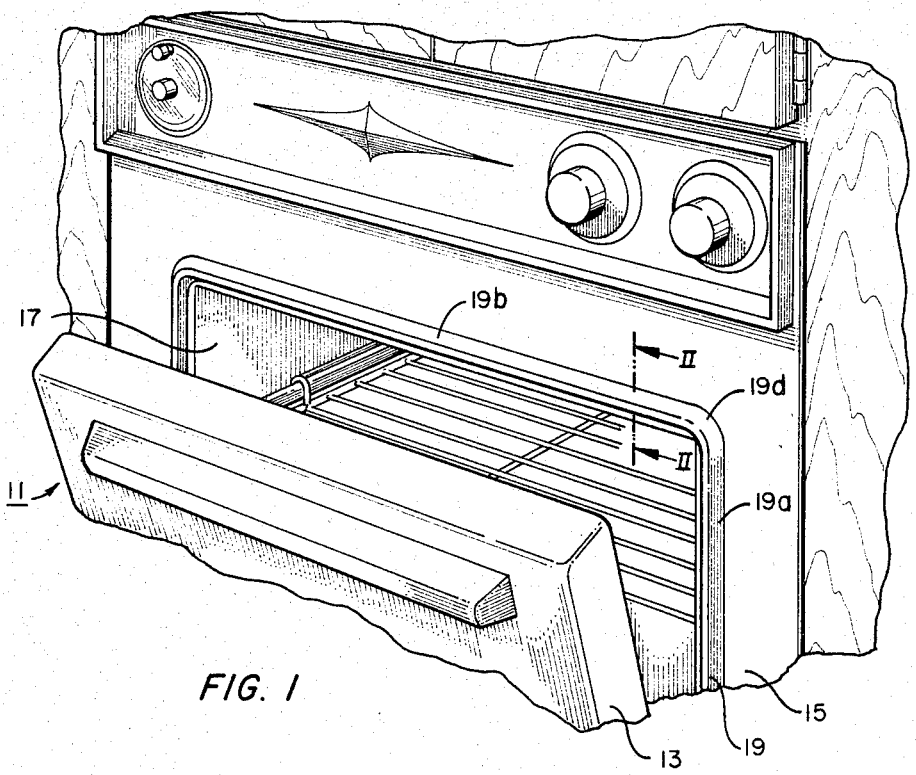
FIG. 1 is a partial perspective view of an oven having a gasket formed in accordance with this invention.

Referring to FIG. 1, a conventional oven 11 is shown mounted within the wall of a home. Oven 11 has a door 13 which has a hinge (not shown) on its lower end for moving between an open and a closed position. In the closed position, door 13 will fit flush against frame 15 and close the oven opening 17. A gasket 19 surrounds the perimeter of the opening 17 for providing a seal between the confronting surfaces of the frame 15 and the door 13. Gasket 19, as shown in FIG. 3, is in the shape of a rectangular "U", facing downwardly. Gasket 19 has two vertical sides 19*a* that are joined together by a horizontal top section 19*b*. The sides 19*a* each terminate in a lower end 19*c*. Gasket 19 is bent into 90 degree corners 19*d*, which connect the vertical sides 19*a* with the horizontal top section 19*b*. Microwave ovens (not shown) would have gaskets that are rectangular loops with four sides and the ends abutting each other at one point.

Figure 2:
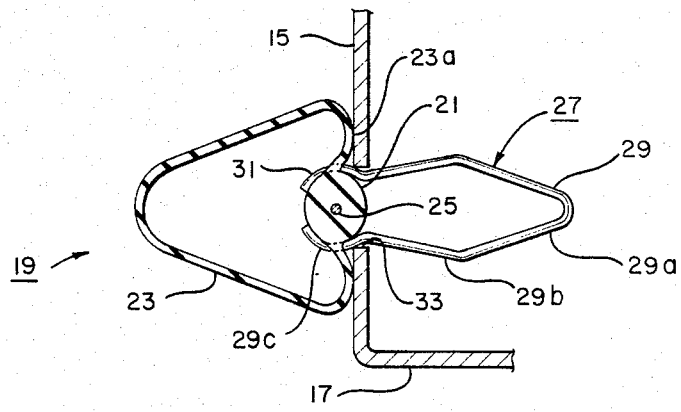
FIG. 2 is an enlarged sectional view of the gasket of FIG. 1, taken along the line II—II of FIG. 1.

Referring to FIG. 2, each gasket 19 has a base 21 that extends the full length of the gasket and is of a generally elliptical shape. A tubular portion 23 joints base 21. Tubular portion 23 is preferably triangular in shape and preferably hollow. Tubular portion 23 has adjoining sections 23*a* that join the sides of the base 21. The adjoining sections 23 will contact the frame 15, while the tubular portion 23 will protrude outwardly for contact by the door 13. An inner portion of base 21 will thus be located within the hollow interior of the tubular portion 23, while an outer portion of the base 21 will be located exterior of the tubular portion 23.

A ductile metal wire 25, preferably single strand, extends axially through the base 21. Wire 25 is much smaller in diameter than base 21 and extends parallel to the axis of the gasket 19. Wire 25 is sufficiently ductile so as to be easily bent by hand. Moreover, the wire should have sufficient strength so as to retain the gasket 19 in the desired configuration after bending. Wire 25 extends the full length of the gasket 19.

A plurality of clips 27 are used to releasably mount the gasket 19 to the frame 15. Each clip 27 is bent into a loop to define two legs 29. Each clip is of a resilient or spring-type material, preferably metal.

Each leg 29, beginning at the doubled-back portion or bight, has a straight portion 29*a* that diverges from the opposite leg. About midway along the length of the leg 29, each leg 29 is bent at an obtuse angle to provide a straight portion 29*b* that converges toward the straight portion 29*b* of the opposite leg. At the end of the converging portions 29*b*, each leg is bent into a curved gripping portion 29*c* that has a radius of curvature generally that of the gasket base 21. The curved section 29*c* terminates in an end 31 for each leg 29.

To manufacture gasket 19, a conventional extruder (not shown) is used with a die formed in the shape of the cross-section of gasket 19. Uncured silicone rubber is fed into the extruder, which forces the material out from the extruder in the configuration shown in FIG. 2. A roll of wire 25 is mounted to the extruder for feeding into the extruder at the die so as to simultaneously draw the wire as the gasket 19 is being formed.

The uncured extruded gasket 19 and wire 25 is drawn through a vulcanizer in a conventional manner, by drawing the material along a belt. The gasket 19 will cure due to the temperature of the vulcanizer as it is drawn along the belt. Friction of the gasket 19 material on the belt will cause the wire 25 to be drawn along simultaneously. As the gasket 19 proceeds from the vulcanizer, it will be cut into desired lengths and placed on a tray. The material is then heated in an oven for final curing.

The gaskets can be preformed into the rectangular shape shown in FIG. 3 by the gasket manufacturer, or the gaskets can be shipped in bulk to the oven manufacturer where they will be formed at that point. In either case, the gaskets are formed into the configuration of FIG. 3 simply by hand, or machine bending the corners 19*d* at the desired points. Clips 29 are then secured to gasket 19, generally as indicated in FIG. 4. The clip will be pressed against the gasket 19, causing the ends 31 of the clip 27 to pierce the adjoining sections 23*a* of the tubular portion 23. In the relaxed condition, the legs of the clip 27 will be more closely spaced than the diameter of the base 21. Thus, the clip legs 29 must be spread slightly apart when pressing the ends 31 into the adjoining sections 23*a* at the points where the adjoining sections 23*a* join the base 21. Once the clip 27 is released, it will tend to return to its normal state, inwardly on the base 21 to tightly grip the gasket 19.

The gasket 19 is then installed on the oven frame 15 by pressing the legs 29 through apertures 33 provided in the frame 15, as shown in FIG. 2. Apertures 33 will be of a diameter that is less than the distance across legs 29 at the maximum point where the sections 29*a* and 29*b* join. When pressing the clips 27 within, the legs 29 will thus be squeezed inwardly. Once pressed into the aperture 33, as shown in FIG. 2, the legs 29 will expand outwardly to return to the normal shape, serving as a retaining portion of clip 27 for retaining the gasket 19 to the frame 15. When the door 13 is closed the deforming or tubular portion 23 will collapse to provide cushioning and to seal.

The invention has many advantages. The gasket can be shipped in bulk to an oven manufacturer, where he will be able to cut the gaskets to his desired lengths, locate the clips at the desired points, and easily mount the gaskets to the oven. This reduces overall labor and requires less variety of inventory than the gaskets used in the prior art. The oven manufacturer may also purchase the gasket pre-assembled to their specification.

While the invention has been shown in only one of its forms, it should be apparent to those skilled in the art that it is not so limited but is susceptible to various changes without departing from the scope of the invention.

I claim:

1. In an appliance having a door and a frame with confronting surfaces, and sealing means for sealing between the two confronting surfaces, comprising in combination:

an elongate gasket member of elastomeric material, having a base for mounting to one of the confronting surfaces and a deforming section protruding outwardly from the base for sealing contact with the other of the surfaces;

a wire extending through the base parallel with the longitudinal axis of the gasket member, the wire being sufficiently ductile to be bent into a selected shape and having sufficient strength for retaining the gasket member in the selected shape; and clip means for gripping the base and for releasably securing the base to one of the confronting surfaces, the clip means comprising a plurality of resilient clips, each having a pair of spaced apart ends adapted to pierce a portion of the deformable section to grip the base, and a retaining portion adapted to squeeze inwardly to extend through an aperture provided in one of the confronting surfaces and expand outwardly once within the aperture to retain the gasket member with the appliance.

2. The sealing means according to claim 1 wherein the wire is capable of being bent into a configuration having two sections perpendicular to each other.

3. In an appliance having a door and a frame with confronting surfaces, and sealing means for sealing the door when closed against the surface of the frame, the sealing means comprising in combination:

an elongate gasket member of elastomeric material having a solid base for mounting to one of the confronting surfaces and a hollow tubular section protruding outwardly from the base for sealing contact with the other of the surfaces when the door is closed;

a wire embedded within the base parallel with the longitudinal axis of the gasket member, the wire being sufficiently ductile to be bend into a 90 degree corner, and having sufficient strength to retain the gasket in the shape of the corner once bent; and a plurality of resilient clips, each being bent into a loop with the ends of the clip adapted to piercingly extend through the tubular section to an inner portion of the base, the loop adapted to be snapped into an aperture provided in one of the confronting surfaces.

* * * * *